United States Patent [19]

Lazar

[11] Patent Number: 4,698,109

[45] Date of Patent: Oct. 6, 1987

[54] METHOD OF MAKING FLOATABLE SHEET MATERIAL

[75] Inventor: Stanley Lazar, Willowdale, Canada

[73] Assignee: Cantar Corporation, Canada

[21] Appl. No.: 938,040

[22] Filed: Dec. 4, 1986

Related U.S. Application Data

[62] Division of Ser. No. 606,601, May 3, 1984, Pat. No. 4,628,549.

[51] Int. Cl.[4] ..... B32B 31/00; B32B 31/06; B32B 31/08; B32B 31/20

[52] U.S. Cl. ..... 156/145; 156/292; 156/308.4; 156/324; 4/498; 5/455

[58] Field of Search ..... 156/145, 292, 308.4, 156/324; 5/455, 474; 4/498, 503

[56] References Cited

U.S. PATENT DOCUMENTS

| | | | |
|---|---|---|---|
| 2,870,454 | 1/1959 | Schippert | 4/503 |
| 2,870,455 | 1/1959 | Reeves | 4/498 |
| 4,028,750 | 6/1977 | Gustafsson | 428/137 X |
| 4,658,452 | 4/1987 | Brockhaus | 5/455 X |

*Primary Examiner*—Donald E. Czaja
*Assistant Examiner*—Jeff H. Aftergut
*Attorney, Agent, or Firm*—Murray and Whisenhunt

[57] ABSTRACT

A floatable on water, translucent laminated plastic sheet material having a plastic embossed film with a plurality of embossments dispersed thereon except at the longitudinal edges thereof. The embossments are spaced apart and separated by land areas and a plastic backing film is laminated to the embossed film at the said longitudinal edges and at the land areas. Thus air containing buoyant cells are formed by the embossments of the embossed film and the backing film. The improvement comprise a fibrous material laminated to the sheet material at least at the longitudinal edges thereof, whereby the edges are reinforced by the fibrous material and the edges may be attached to correspondingly reinforced edges of another of the sheet material without substantially weakening the attached sheets of material at the attachments thereof.

10 Claims, 6 Drawing Figures

METHOD OF MAKING FLOATABLE SHEET MATERIAL

This is a divisional application of Ser. No. 606,601 filed May 3, 1984 now U.S. Pat. No. 4,628,549.

The present invention relates to a floatable sheet material and to a method of making that floatable sheet material. More particularly, the invention relates to such floatable sheet material which may be assembled into covers for swimming pools.

BACKGROUND OF THE INVENTION

Flotable sheet material has been used in the art for covering swimming pools so that during the cooler part of the swimming season, the floatable sheet material will retain the heat in the swimming pool water and, additionally, allow the water to be heated by sunlight. These covers are normally made of a translucent plastic which has been rendered buoyant so that the covers float on the swimming pool water but will allow the sun's rays to pass through the covers and heat the water in the pool. During cooler periods, these covers prevent loss of heat from the water in the swimming pools. The covers are not normally secured to the sides of the pool, but are originally manufactured, or cut, to substantially cover the water in the pool. When the pool is to be used, the covers are removed, often by rolling onto a reel system near the pool, and are again replaced on the pool when the pool is not in use.

The pool covers experience substantial stress when being removed from the pool or replaced thereon. Not only are the covers often of considerable size, and hence weight, e.g. 20 ft.×40 ft., but especially when removing the covers from the pool, the covers will be wet and will entrain some water, thereby increasing the weight. Thus, the covers can be quite heavy, and correspondingly substantial strain is placed on the covers when removing from or placing on the pool. In addition, strong winds can move the covers about the pool, since they are free floating on the water, and that wind action can place additional stress on the covers.

As can be therefore appreciated, the covers must be strong and be able to withstand considerable stress, or otherwise the covers will deteriorate with use and begin to tear. Once the covers tear, they are, of course, more difficult to remove and replace on the pool and the stress during such removal and replacement increases the likelihood of causing greater tears.

Such pool covers may be made by a variety of methods, but by far most of the pool covers are made by attaching sections of floatable on water (buoyant), translucent laminated plastic sheet material. This sheet material is produced by laminating an embossed film with a plurality of embossments dispersed thereon to a backing film whereby air containing buoyant cells are formed by the embossments of the embossed film and the backing film. The laminated sheet material is usually made in widths of about 4 or 6 feet, and in continuous running lengths. The edges of the continuous running lengths (the longitudinal edges) are not embossed and do not, therefore, contain the buoyant cells. The running lengths of the sheet material are cut to appropriate lengths for a particular pool length and the width of the pool cover is achieved by attaching, one to the other, the appropriately cut running lengths. For example, for a 20 ft. wide and 40 ft. long pool cover, 4 feet wide running lengths are cut to sections of approximately 40 feet in length, and five of these 4 feet wide sections are attached, edge to edge, in order to provide the required 20 foot width of the pool cover.

The edges are attached, one to the other, by a variety of methods, but unfortunately all of these methods weaken the edges at the points of attachment. For example, when the edges are attached, one to the other, by heat sealing, that heat sealing weakens the attached edges. In addition heat sealing distorts the films and the pool cover will not lie flat on the water, resulting in an unsightly appearance. Similarly, when the edges are attached by adhesives or the like, the adhesives will likewise weaken and distort those attached edges, since an adhesive, in order to be effective, must in part dissolve the plastic of the sheet material. The strongest means of attachment of the edges are by sewing, but here again, the needle punctures of the edges during the sewing operation weakens the attached edges.

Thus, generally speaking, the weakest points of the pool cover are along the attachments of the edges of the sheet material. With continued use of the pool cover, as explained above, these weakest points begin to give way and the pool cover will tear and become unserviceable.

It would therefore be of substantial advantage to the art to provide such sheet material, where sections of the sheet material can be attached, edge to edge, without substantially weakening the attached sheets of materials at the attachments thereof. Correspondingly, it would be of decided advantage to the art to provide pool covers where the attachments of the sheet material do not substantially weaken the sheet material at the attachments thereof. Finally, it would also be a substantial advantage to the art to provide methods for producing such improved sheet materials and pool covers.

BRIEF DESCRIPTION OF THE INVENTION

The present invention is based on three primary discoveries, and several subsidiary discoveries. First, it was discovered that the conventional method of manufacture of the buoyant sheet material is amenable to modification such that during manufacture of the sheet material longitudinal edges of the continuous running lengths of sheet material can be easily and inexpensively reinforced. In this regard, it was discovered that the introduction of a reinforcement, at least along the longitudinal edges, neither substantially complicates the conventional process or substantially increases the cost of production of the sheet material. Further, and surprisingly, it was discovered that the introduction of such reinforcement, at least along the longitudinal edges of the sheet material, did not interfere with the conventional lamination of the embossed film to the backing film in order to provide the buoyant cells.

Second, it was discovered that such reinforcement, at least along the longitudinal edges, substantially avoided the problem of tearing of attached sections of sheet material (in the form of a pool cover) even with continued use, and even when the attachments were accomplished by the convenient conventional manners such as heat sealing and sewing.

These two primary discoveries, therefore, allowed the production of much improved sheet material without substantially increasing the steps of operating the conventional process for making the sheet material or substantially increasing the expense of producing the sheet material. This is a considerable advantage of the present invention. It will be appreciated in this regard, that the pool cover market is a highly competitive market, and any substantial increases in the cost of either operating the conventional process or producing the conventional pool covers would be a decided disadvantage in the marketplace.

Third, it was most unexpectedly found that the amount of reinforcing required at the longitudinal edges to avoid tearing along the points of attachment is quite small. In this regard, it will be appreciated that the sheet material is made of plastic films having very low tear strengths, and once a small tear occurs at the points of the attachment of the sections of sheet material, that tear will relatively rapidly further develop in the plastic films. However, with even a small amount of reinforcement at longitudinal edges, the low tear strength of the plastic films is overcome and small tears at the points of attachment will not propagate into large tears which make the pool cover unserviceable.

As a subsidiary discovery to the above, it was found that the most efficient reinforcement is that of a fibrous material, since during lamination of the embossed film to the backing film, the fibrous material can be laminated to the resulting sheet material so as to provide tear resistance in essentially all directions. This, of course, is opposed to a non-fibrous material, such as a more tear resistant plastic film or foam. As a further subsidiary discovery in this regard, it was found that the fibrous material may be either woven or non-woven fibrous material and, as noted above, only small amounts thereof need be used. Indeed, the fibrous material may be in the form of only a scrim which is, as is well known in the art, an exceptionally thin and lightweight fibrous material. This is the preferred embodiment for the reasons explained below.

Finally, it was discovered that in the case of lightweight woven or non-woven fibrous materials, e.g. scrims and fabrics, the backing film for the sheet material may be constituted by a coating or lamination on the fibrous material and thus the fibrous material may be essentially co-extensive with the entire sheet material. This not only provides the desired reinforcement at the edges, but also reinforces the entire pool cover, especially against abrasion of the pool cover when removing the pool cover from the pool and when replacing the pool cover thereon.

Accordingly, briefly stated, the present invention is an improvement in a floatable on water, translucent laminated plastic sheet material. The sheet material has a plastic embossed film with a plurality of embossments dispersed thereon except at the longitudinal edges thereof. The embossments are spaced apart and separated by land areas between the embossments. A plastic backing film is laminated to the embossed film at the longitudinal edges and at the land areas. Thus, this lamination provides air containing buoyant cells which are formed by the embossments of the embossed film and the backing film. This is a conventional sheet material for producing pool covers, and the present improvement comprises a fibrous material laminated to the sheet material at least at the longitudinal edges thereof, whereby the edges are reinforced by the fibrous material and the edges may be attached to correspondingly reinforced edges of another section of sheet material without substantially weakening the attached sheets of material at the attachments thereof.

Similarly, there is provided an improvement in the process for producing a floatable on water, translucent plactic sheet material. In the process, the above-identified embossed film is laminated to the above-identified backing film at the edges and land areas to form the buoyant cells, as identified above, and the improved process is laminating fibrous material to the sheet material at least at the longitudinal edges thereof, whereby the edges are reinforced by the fibrous material and the edges may be attached to correspondingly reinforced edges of another section of sheet material without substantially weakening the attached sheets of material at the attachments thereof.

DETAILED DESCRIPTION OF THE INVENTION

As noted above, the present improved sheet material may be produced with only a slight, and therefore, advantageous, modification of the conventional process for making such sheet material. For sake of conciseness, the details of the conventional process for making the sheet material will not be discussed herein in detail, since those details are well known to the art. Thus, details of such conventional processes are disclosed in U.S. Pat. Nos. 3,026,231; 3,142,559; 3,208,893; 3,294,387; and 3,416,984. The latter patent represents the more usual form of this conventional process and is specifically incorporated herein by reference for those details.

Figure 1:
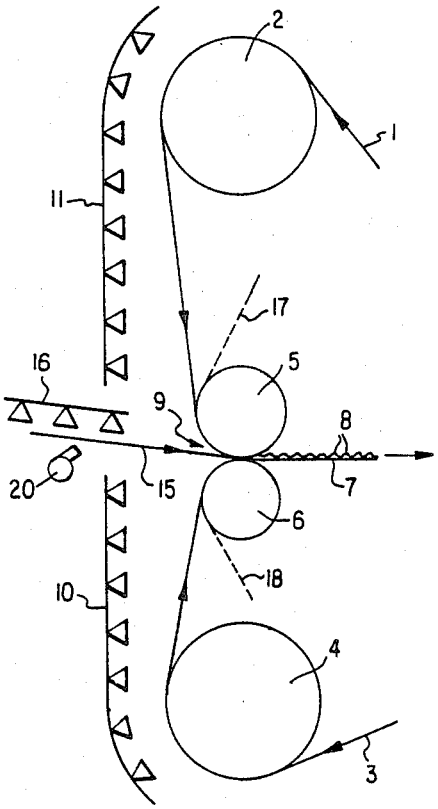
FIG. 1 is a diagrammatic illustration of the conventional process and apparatus for producing the present sheet material, but is modified to carry out the present process and produce the present improved sheet material.

However, the conventional process can be understood by reference to FIG. 1. In that process, a plastic film 1 is pre-heated on a heating drum 2. Similarly, plastic film 3 may be pre-heated (pre-heating is not required), on a heating drum 4. Drum 2 and, if desired, drum 4 contain hot water, oil, steam or the like. The plastic film 1, the film to be embossed, is referred to in the art as the embossed film, even prior to its embossment, and that terminology will be used hereinafter. Likewise, the other film 3 is referred to as the backing film, since it backs the embossments of the embossed film and that terminology will be used hereinafter.

The embossed film 1 and the backing film 3 are passed through a nip formed between an embossing roll 5 and a backing roll 6. The embossing roll 5 has a plurality of cavities in its surface, which cavities are connected to a vacuum source so that when the embossed film is contacted by the embossing roll (the film being in a preheated condition) the film is sucked into the cavities and embossed. At the same time, the backing film 3 is pressed against the embossed film and laminated thereto. The backing roll 6 is normally covered with an elastomer, e.g. silicone rubber, since it is pressed against the embossing roll at considerable pressures, e.g. 20 to 60 lbs. per linear inch or more. The laminated embossed film and backing film form the present sheet material 7. The outer edges of embossing roll 5 have no cavities therein so that the outer longitudinal edges of the laminated sheet material 7 have no embossments, and hence no buoyant cells. These edges are used for attaching sections of the sheet material together for forming a pool cover.

The embossments 8 on sheet material 7 can be of a variety of sizes and shapes and the particular size and shape is not critical, so long as the buoyant cells produced thereby provide sufficient flotation for the sheet material so that the sheet material will float on water. However, generally speaking, the embossments (and hence the cavities in the embossing roll 5) will be essentially hemispherical or partly hemispherical in shape, and will have diameters are little as $\frac{1}{8}$ inch to as much as $1\frac{1}{2}$ inches, but more usually the diameters will be from $\frac{1}{4}$ inch to $\frac{3}{4}$ inch. Nevertheless, instead of hemispherical shape, the embossments may be cylindrical, rectangular, triangular or any other desired shape, and the particular shape is not substantially important so long as sufficient buoyancy of the sheet material is provided. But more usually, the embossments will be either hemispherical or partly hemispherical, e.g. $\frac{1}{4}$ to $\frac{1}{2}$ of a sphere.

Again, depending upon the particular size and shape of the embossments, the percentage of the area of the sheet material covered by the embossments in order to provide sufficient flotation will vary. Nevertheless, generally speaking, the embossments will comprise at least 20% of the area of the embossed film (20% of the area of the sheet material) but more usually will comprise at least 40% and up to 60–70% of the area of the embossed film (the area of the sheet material). The arrangement of the embossments may also vary, as will be easily appreciated, but more usually the embossments are relatively uniformly dispersed on the embossed film (on the sheet material).

It will be appreciated that in order to emboss the embossed film and to laminate the backing film thereto, those films must be heated, prior to passing through the nip 9 formed between the embossing roll 5 and the backing roll 6, to an elevated temperature sufficient that the embossed film is laminated thereto. This temperature is referred to in the art as the embossing temperature, or alternatly, the laminating temperature, or alternately the sealing temperature, and these temperatures are well known in the art for various plastic films and the details thereof need not be discussed herein for sake of conciseness. However, as an example, the embossing temperature of ordinary polyethylene film is approximately 220° F. However, to insure good lamination of the two films, it is the usual practice to heat at least one of the films, and preferably both of the films, to a temperature above the embossing temperature, i.e. at or near the fusion temperature of the films (that temperature where the films began to lose their tensile properties, but at which temperature the films are very easy to laminate into a permanent lamination). Here again, the fusion temperatures for the various plastic films are well known in the art, but, for example, the fusion temperature of ordinary polyethylene is approximately 270° F. Thus, the heating of the films is such that the embossed film is at least above its embossing temperature but at or below its fusion temperature and likewise, the backing film is at a temperature such that the combination of temperatures of the embossed film and the backing film are sufficient to permanently laminate the embossed film and the backing film.

In order to insure the above noted temperatures and to better control the temperatures of the films, it is a practice in the art to provide additional heat to the films prior to being passed to the nip 9 of embossing roll 5 and backing roll 6. This heat is often applied in the form of radiant heat supplied by radiant heaters 10 and 11. Radiant heaters can be fine tuned for precise temperature control by varying the power thereto.

As noted above, the embossed film will have a plurality of embossments dispersed thereon except at the longitudinal edges thereof. These embossments are spaced apart and separated from each other by unembossed portions of the film referred to in the art as land areas. During the laminating step the backing film is laminated to the embossed film at the longitudinal edges and at those land areas. By such lamination, air containing buoyant cells are formed by the embossments of the embossed film and the backing film.

The foregoing is the conventional process for producing the sheet material of which the present invention provides an improvement. That conventional process, as noted above, is well known in the art and need not be further discussed for sake of conciseness. The modification to that conventional process to provide the present improved process will be discussed hereinafter, but for sake of clarity, the improved sheet material will first be discussed.

As can be appreciated from the above discussion of the conventional process, the plastic films used in the process to produce the sheet material are normally thermoplastic, and indeed the preferred embodiment of the present invention is where the plastic films are thermoplastic. The particular thermoplastic may vary widely but usually the thermoplastic is either polyvinyl chloride or polyvinylidene chloride or an olefin polymer of nylon. It is preferred to use an olefin polymer and polyethylene or polypropylene olefin polymers are most preferred. The plastic films used for the sheet material may or may not have a coating thereon for improving the laminating properties of the films. Such coatings are well known in the art and need not be described herein.

Figure 2:
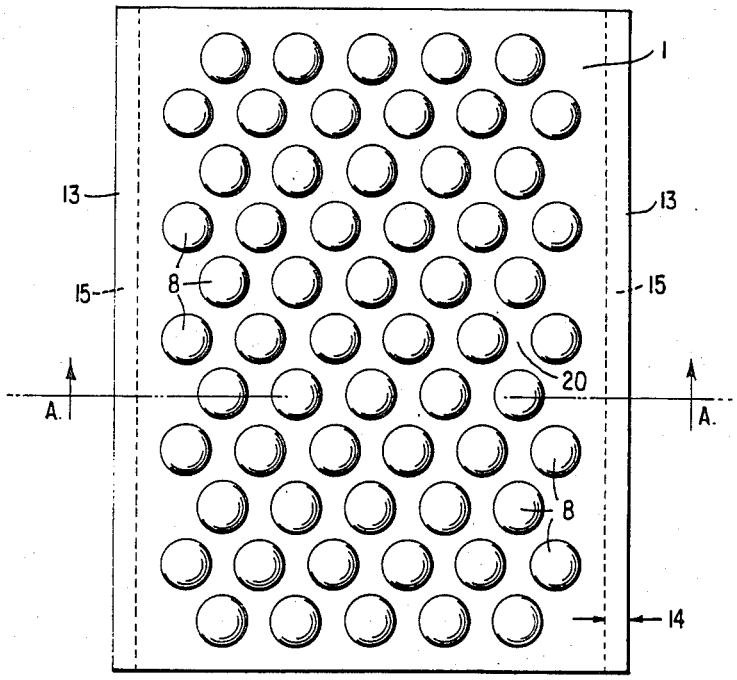
FIG. 2 is a top view of the improved sheet material produced by the improved process.

In order to attach sections of the sheet material for producing pool covers, the continuous running lengths of the sheet material made by the conventional process have unembossed longitudinal edges 13, as shown in FIG. 2. The width 14 of the longitudinal edges 13 can vary considerably, but generally the width of the longitudinal edges are up to about three inches, but more usually the width is from about 0.5 to 2 inches e.g. 1 inch or so.

As will be appreciated from the above description of the conventional process, the sheet material could be produced by means other than heat laminating. For example, the embossed film and the backing film could be laminated by adhesive lamination rather than heat lamination. This is achievable simply by providing that earlier the embossed film or the backing film have a pressure sensitive adhesive thereon, or even a heat activated adhesive thereon. However, it is preferred that the lamination of the backing film to the embossed film be by heat lamination where the films are thermoplastic films and the films are heat laminated together. This is preferred in the present process by reason of the reinforcement introduced into the process and into the product, as briefly described above.

The reinforcement is a fibrous material which is laminated to the sheet material at least at the longitudinal edges thereof. The fibers of the fibrous material may be either natural or synthetic fibers, but synthetic fibers are preferred, especially synthetic fibers which are thermoplastic fibers. When the thermoplastic fibers are made of a thermoplastic similar to the thermoplastic of the films, this allows lamination of the fibrous material to the sheet material with only a very slight modification of the conventioal process for making the sheet material. For example, when the thermoplastic fibers are made of an olefin polymer, e.g. polyethylene or polypropylene, and the films are made of a similar olefin polymer, the laminating temperatures of the fibrous material will be close to the laminating temperatures of the films. By thus providing such a combination of films and fibrous material, the fibrous material may be laminated to the sheet material by feeding the fibrous material into the conventional process. However, it will be appreciated that while the polymer of the fibrous material may be similar to the polymer of the films, preferably the polymer of the fibrous material will not have the same embossing or fusion temperatures of that of the film. If these temperatures were the same for both of the fibrous material and the films, then the chances of melting the fibrous material while embossing and laminating the films would be considerably increased. It is possible, however, to use fibrous materials made of the same material as the films and having the same embossing and fusion temperatures, since the fibrous material will not normally be pre-heated to the extent of pre-heating the films. However, this requires much more careful control of the process and is therefore not the preferred embodiment of the invention.

To avoid the above problem, when the fibrous material is of a polymer similar to the polymer of the films, the fibrous material should have embossing and fusion temperatures at least slightly above those temperatures of the films. For example, the films may be of low density polyethylene and the fibrous materials may be of high density polyethylene. The embossing and fusion temperatures of high density polyethylene are slightly higher than the embossing and fusion temperatures of low density polyethylene. These slight differences in temperature make the process easier to operate and will ensure that the fibrous material remains in the laminated sheet material as distinct fibers and not melted residues thereof. This will be more clear from a description of the process including the present improvements where the fibrous material is feed into the process.

In this latter regard, referring again to FIG. 1, the fibrous material 15 may simply be fed to the nip 9 between embossed film 1 and backing film 3 and along the outer edges of embossing roll 5 where there are no embossing cavities and the longitudinal edges of the sheet material are formed. In one embodiment, the fibrous material 15 is of a material considerably different from the polymers of films 1 and 3, i.e. is either not a thermoplastic or has embossing and fusion temperatures considerably above those temperatures of the plastic films 1 and 3. In this case, the pre-heating of films 1 and 3 may be to higher temperatures by drums 2 and 4 and radiant heaters 11 and 10, than that necessary to laminate the films, these higher temperatures being sufficient to compensate for the lower temperature of reinforcing material 15. These high temperatures need not be substantially greater than the temperatures practiced in the ordinary process without the fibrous material, since the amount of fibrous material used for reinforcing purposes, as noted above, can be quite small. Thus, in this case, when lamination actually occurs between rolls 5 and 6, the temperature of all of the embossed film, backing film and fibrous material will be essentially the same by virtue of close contact therebetween in entering the nip 9 between rolls 5 and 6 and during passing through the nip 9 of rolls 5 and 6. Since in this case the temperatures of all of the embossed film, backing film and fibrous material will be essentially the same, the fibrous material may be laminated to the sheet material with no substantial change to the conventional process other than feeding the fibrous material thereto. This is a very important advantage of the present invention, since this embodiment requires very little modification of the conventional process and very little additional equipment.

In another embodiment, the fibrous material may be heated to about the lamination temperature of the films. Since also as noted above, very small amounts of such fibrous material are required for adequate reinforcing, the fibrous material may be very conveniently heated to about that lamination temperature by very inexpensive and simple means. Thus, for example, a bank of radiant heaters 16 disposed next thereto (See FIG. 1) may be used. These heaters may be disposed on only one side of the fibrous material, as shown in FIG. 1, or on both sides. Further, since rolls 5 and 6 may also be heated, and indeed roll 5 is usually heated in the conventional process, additional heat to achieve lamination of all of film 1, film 3 and fibrous material 15 may be supplied thereby. Optionally, of course, combinations of heating drums and radiant heaters, as explained above, may be used. The purpose of heating the fibrous material to about the lamination temperature of the films is simply for convenience in controlling the temperatures of lamination. Thus, rather than heating the films 1 and 3 higher than necessary for lamination thereof in order to accommodate the cooler unheated fibrous material, by heating the fibrous material to near the lamination temperatures, films 1 and 3 can be processed in the manner normally practiced in the art and without any changes in the temperatures of that normally practiced process. Thus, the temperature to which the fibrous material is heated is decidedly not cricitial, and can be from, indeed, unheated fibrous material up to the embossing or fusing temperatures of the films to be laminated, but more generally will be somewhere near the lamination temperatures of those film.

Figure 3:
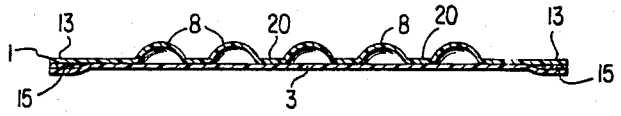
FIG. 3 is a cross-section of the sheet material of FIG. 2, taken along lines A—A and showing reinforcement only at the edges of the sheet material.

The fibrous material may be laminated to the sheet material in positions other than that described above. For example, the fibrous material may be laminated to the sheet material by feeding the fibrous material between embossed film 1 and embossing roll 5 as shown by dotted line 17 indicating fibrous material. Likewise, the fibrous material may be fed between backing film 3 and backing roll 6, as shown by dotted line 18. Of course, in both of these latter embodiments, heaters, such as radiant heaters 16, may be, and preferably are, provided for the same reasons explained above. Nevertheless, it is preferred that the reinforcing be laminated between embossed film 1 and backing film 3 as shown in FIG. 1. FIG. 3 shows this preferred embodiment where the embossed film 1 with embossments 8 separated by land areas 20 are laminated to backing film 3 with the fibrous reinforcing material 15 laminated therein between at longitudinal edges 13. It will be noted that in this embodiment that the fibrous material is substantially co-extensive with the longitudinal edges, i.e. essentially the entire area of the edges have fibrous material laminated thereto. The preferred embodiment, as noted above, is where this co-extensive lamination of fibrous material is laminated into the sheet material, i.e. between the embossed film 1 and the backing film 3.

However, the reinforcing material need not be only at the longitudinal edges of the sheet material. Thus, when a fibrous material is in a batt, scrim or fabric form, of essentially the same width as the width of the embossed film, the backing film may actually take the form of a coating on the fibrous material or a lamination of the backing film on the fibrous material. In this embodiment, therefore, the fibrous material is substantially co-extensive with the embossed film, i.e. the width of the embossed film is essentially the same as the width of the fibrous material. This embodiment not only provides the above described reinforcements at the longitudinal edges of the sheet material, but in additio reinforces the entire sheet material. This is a particular advantage in that it will provide additional strength to a pool cover made from the sheet material so that the pool cover can withstand greater stress, and particularly greater abrasion, in removing the pool cover from the pool and replacing the pool cover thereon. In this regard, the fibrous material can simply be in batt (non-consolidated) form but for added strength, it is preferred that the fibrous material be in scrim or fabric form, i.e. a woven or non-woven scrim or fabric. This allows the coating or lamination on the scrim or fabric to provide the backing film by means of conventional fabric coaters and laminators.

Figure 4:
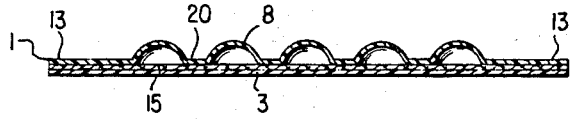
FIG. 4 shows another embodiment wherein the reinforcing material is co-extensive with the width and length of the sheet material.

FIG. 4 illustrates this embodiment where the fibrous material 15 is in the form of a woven or non-woven scrim fabric and the backing film 3 is in the form of a coating or lamination on the fabric to form a coated or laminated scrim or fabric. Of course, if desired, the positions of the scrim or fabric 15 and coating or lamination 3 could be reversed such that the fibrous material 15 is on the bottom side of backing film 3 (in the form of a coating or lamination), as opposed to that actually shown in FIG. 4. In either case, however, the coated or laminated scrim or fabric is essentially co-extensive with the embossed film (as shown in FIG. 4).

Again, as described above, in this latter embodiment the coating or lamination film is preferably a heat sealable coating or lamination film, preferably of the same material as the plastic films, e.g. an olefin polymer such as polyethylene or polypropylene.

Figure 5:
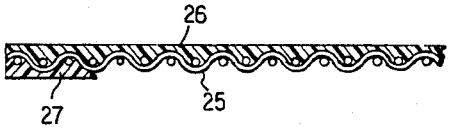
FIG. 5 shows an enlarged view of the embodiment of FIG. 4, in connection with the backing film thereof.

FIG. 5 shows such a resulting sheet material in expanded detail. In that figure the fibrous material 25 is a woven scrim and has a lamination film 26 thereon. Optionally, the scrim may have a lamination film on both sides and the second lamination film 27 (shown only partially in FIG. 5) may be disposed on the opposite side of scrim 25 from lamination film 26.

As noted above, it was surprisingly found that the fibrous material need not be disposed on the sheet material in any great amount from a weight point of view, and this is an important advantage of the invention. Indeed, adequate reinforcement is provided merely by a woven or non-woven scrim. A scrim is a very lightweight fabric having weights of between abut 1 and 4½ ounces per square yard, especially about 3–4 ounces per square yard. For example a woven scrim of high density polyethylene having warp and weft yarn counts of as little as 4 per inch may be used, although at least 5 per inch is preferred. When very lightweight scrims are used, such as those immediately described above, another important advantage of the invention may be realized. Thus, the very lightweight scrim may be laminated to the backing film in a separate operation from that shown in FIG. 1, and the resulting lamination of the very lightweight scrim and backing film can be substituted in the process shown in FIG. 1 for backing film 3 and no separate feeding of fibrous material 15 is required. Such lightweight scrims, also, do not substantially effect the laminatio of embossed film 1 to backing film 3, and thus the conventional process may be operated without any substantial change at all, other than substituting for backing film 3 the previously laminated lightweight scrim and backing film. The lamination of the lightweight scrim to the backing film, in a separate operation, can be done on conventional laminators, the operation of which is well known to the art. Alternatively, combinations of certain polymeric lightweight scrims and polymeric films are commercially available from the DuPont Company. For example, the DuPont Company has commercially available a lightweight scrim, of the nature described above, made from high density polyethylene which is laminated to a film of low density polyethylene. This commercially available product is quite acceptable for the present process. While this commercially available lamination does not give maximum reinforcement, in the nature described above, the reinforcement provided is, nevertheless, quite adequate for many uses of the sheet material in producing pool covers. This is because the reinforcing stops tears, primarily induced by stitching for attachment of the sheet materials, as explained above, from developing into longer tears. The fibrous reinforcement, therefore, serves as a tear stop and even lightweight scrims, of the nature described above, are effective in this regard. This will be better understood from the explanation, below, in regard to attachment of the sheet materials to form a pool cover.

Essentially the same process as described above in connection with a lamination of a lightweight scrim onto a film as a separate step of the process may also be conducted in reinforcing only the longitudinal edges of the sheet material. Thus, the same type of lamination of a lightweight scrim and a film may be used in addition to the films as shown in FIG. 1, i.e. embossed film 1 and backing film 3. However, in this embodiment, the lamination of the lightweight scrim and film will be fed into the process in the same manner shown in FIG. 1, but in this case the lightweight scrim and film lamination will be substituted for fibrous material 15 in FIG. 1. For example, rolls of lamination of lightweight scrim and film having the required width for the longitudinal edge desired, are simply disposed at each longitudinal edge of film 1 and film 3 and fed into nip 9 in the manner shown in FIG. 1. This will dispose that lamination at the longitudinal edges of the films and will be heat sealed between films 1 and 3, as shown by 15 in FIG. 3.

This latter embodiment of the process has a further advantage. The lamination of the lightweight scrim and film make the fibrous material much easier to handle, especially when the fibrous material is in a very lightweight form, such as the lightweight scrim described above, or in the form of an unconsolidated material, e.g. a batt or lightly consolidated felt. In addition, this embodiment of the invention has yet another further important advantage. Since the lightweight scrim, for example, is already laminated to a film, this allows the lamination of scrim and film to be further coated, preferably on both sides, with a coating which allows an easier heat seal of embossed film 1 and backing film 3. For example, where the lightweight scrim is made of a high density polyethylene and the film laminated thereto is made of a low density polyethylene, similar to the low density polyethylene normally used for films 1 and 3, it will be necessary to bring the temperature of the laminated scrim up to or close to the embossing temperature or above, e.g. near the fusion temperature, to ensure that a good heat seal occurs between films 1 and 3 and the laminated scrim. However, the necessity to bring the laminated scrim to those higher temperatures can be avoided by simply coating the laminated scrim with coating materials which will fuse at lower temperatures. Thus, for example, a lamination of a high density polyethylene scrim with a low density polyethylene film can be coated with yet a lower density polyethylene coating, preferably on both sides, and that yet lower density polyethylene coating will fuse to both films 1 and 3 at a much lower temperatures and give a good heat seal between all of films 1 and 3 and the laminated scrim. Lower density polyethylene coatings can be adequately heated to such fusion temperatures by lesser amounts of heat than required by, for example, infrared heaters 16, as shown in FIG. 1, and can be quite adequately heated to fusion temperatures by more simple means, such as an air gun 20, as shown in FIG. 1.

Indeed, the same types of coatings, as explained in the foregoing paragraph, may be used when a lamination of the fibrous materials and the film is used in lieu of backing film 3, as explained above. In this case, however, after laminating the fibrous material, e.g. a lightweight scrim, to the backing film, that lamination is then coated, preferably on both sides, with an appropriate coating material having lower fusion temperatures. This will insure that the lamination of the fibrous material and film, used in lieu of backing film 3, can be processed in the same manner as the conventional process which uses ordinary homogeneous films as embossing film 1 and backing film 3. It will be appreciated in this regard, that the presence of the fibrous material, which will be of a higher melting point than the film to which it is laminated can cause some minor distrubances in the conventional process and may require some higher temperatures for adequate heat sealing. However, with the coatings on the laminatio of fibrous material and backing film, no substantial adjustment of temperatures or other operating parameters are required, and the process can be practiced in a very conventional manner and merely by substituting the lamination of the fibrous material and the backing film for the backing film 3 of FIG. 1. This makes operation of the process exceedingly simple and inexpensive, and for this reason is the preferred embodiment of the invention.

Instead of providing a further coating on a laminated scrim, as described above, the lightweight scrim may be coated directly with a coating having a lower fusion temperature (no prior lamination of the lightweight scrim and a film). Such coated scrim may be used in the same manner as described above, i.e. either only at the longitudinal edges or over the entire width of the sheet material or in lieu of the backing film 3.

Figure 6:
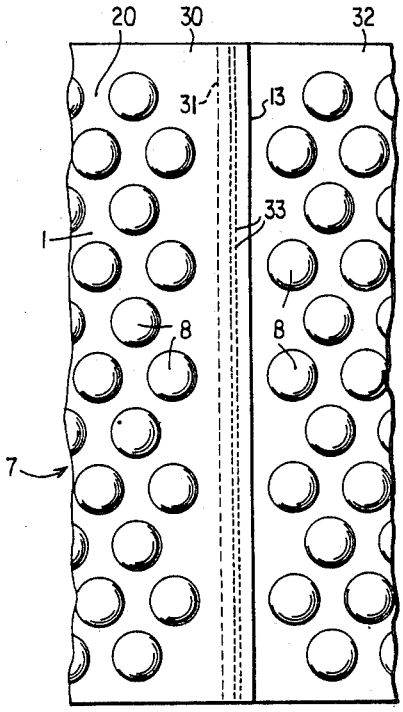
FIG. 6 shows a partial top view of two attached sections of the sheet material.

The sheet material is attached to at least one other corresponding reinforced sheet material, i.e. having at least reinforcement in the longitudinal edges thereof, for forming a swimming pool cover. A partial section of such cover is shown in FIG. 6. Thus, the longitudinal edge 13 of one section 30 overlaps the underlying longitudinal edge 31 (shown as dotted lines) of another section 32 of sheet material and these two sections are attached at attachment points 33, shown in the drawing as double stitches. The threads used for the stitching may be any threads, but again are preferably synthetic threads, e.g. fibrous polyethylene or polypropylene threads. However, instead of stitching, as shown in FIG. 6, the attachment may be by heat sealing, which is another means of attachment commonly used in the art, although this is not preferred for the reasons explained above. The required number of sheet material to form the desired width for the pool cover are similarly attached. Of course, prior to attaching sections of the sheet material, the continuous running lengths of sheet material are cut to appropriate lengths for the size of the pool covered.

As will be appreciated from the foregoing description of the process and the product, i.e. the sheet material, a major feature of the invention is in providing an inexpensive and easy to operate process for producing a much improved sheet material, especially from a tear resistant point of view, and concomitantly a much improved product with little or no additional cost in the product itself. The improved tear resistance is a result of a disposition of the fibrous material. It can be easily appreciated that when a tear begins to develop in a homogeneous material, such as plastic films, the tear propagation in that material will go exceedingly rapidly. However, that propagation of the tear is either eliminated or substantially reduced by the present reinforcement. As the tear propagates, it will encounter the laminated reinforcements and at that point of the reinforcement, i.e. the fibrous material, tear resistance considerably increases. Stated another way, tear propagation is considerably reduced and if the tear exceeds the first encounter of the fiber of the fibrous material, it will encounter subsequent fibers of the fibrous material and again tear propagation will be substantially reduced. It can therefore be seen, that the amount of fibrous material required for substantial reinforcement is very small indeed and this is an important discovery of the invention. While the lightweight scrims, as described above, are quite adequate, the reinforcement may be of a much more substantial nature, if desired. That reinforcement can be to the extent of a tightly woven relatively heavy fabric, e.g. up to 10 to 12 ounces per square yard, but reinforcement of this magnitude is really not necessary, and only serves to increase the cost of the sheet materials produced. Heavier reinforcements of this nature, however, are of advantage when disposed across the entire sheet material, since the heavier reinforcement will provide greater abrasion resistance in removing and replacing the pool covers on the pool, as explained above. Similarly, instead of heavy woven fabrics, heavy non-woven fabric may be used, with a like result.

The invention will now be illustrated in connection with the following example. It should be understood, however, that the invention is not restricted to this example, but extends to the breadth of the foregoing disclosure and following claims. The example, however, does goes to the preferred embodiment of the invention, especially in regard to producing the improved product at a minimum cost.

EXAMPLE

A conventional "bubble" laminating machine, manufactured by the Canadian Tarpoly Company, as diagrammatically shown in FIG. 1, was threaded with low density polyethylene film. The embossed film was 8 mils thick and the backing film 3 was 3 mils thick. Each film was 53 inches wide. Hot water at temperature between 120° and 130° F. was circulated through embossing roll 5. Backing roll 6 had a non-stitch elastomeric covering thereon (silicone rubber). The pressure between rolls 2 and 4 was about 40 to 50 pounds per linear inch. Ten radiant heaters (I.R. heaters) 11 and ten radiant heaters 10, powered at about 5500 watts each, preheated, respectively films 1 and 3. Each bank of heaters, 10 and 11 were laterally movable, away from and towards, each film and the film temperatures were adjusted by such movement so that each film in a steady state of processing were heated to the laminating temperature (determined by when films 1 and 3 permanently laminate together).

Coated scrim 15 was fed at each longitudinal edge of the films 1 and 3 and between each of the films. The coated scrim had a weight of about 3 oz. per square yard and was made of high density polyethylene woven fabric (about 5 warp and weft threads per inch) with a low density polyethylene coating on both sides thereof (made by the DuPont Company). Each scrim was preheated with a hot air gun 20, operated at about 2000 watts. Under steady state conditions the film speeds (and product speed) was about 45 feet per minute.

The resulting embossed laminate was selvaged to about a 4 feet width and cut to 40 feet long sections. Four such sections were double stitched along the edges thereof (through the scrim laminated between the embossed and backing films) with fibrous polypropylene thread using a 300 W double stitch headed Singer sewing machine and chain stitching. The resulting pool cover was strong and durable.

As can be seen from the above, the process of the present invention is an inexpensive and easy to operate modification of the conventional process for making sheet materials of the present nature. Thus, the increased costs of processing is minimal. Additionally, since the reinforcing material can be quite small in relationship to the weight of the plastic films, the additional cost for the reinforcing material can be quite small. Under these circumstances, the invention provides a very much improved sheet material, and hence pool cover, with only very small increases in costs thereof. This is a substantial advantage to the art.

I claim:

1. In a process for producing a floatable on water, translucent laminated sheet material by embossing a plastic film to form an embossed plastic film having a plurality of embossments dispersed thereon except at the longitudinal edges thereof, said embossments being spaced apart and separated by land areas between said embossments, and laminating to said embossed film a plastic backing film at the said longitudinal edges and at said land areas whereby air containing buoyant cells are formed by the embossments of the embossed film and the backing film, the improvement comprising laminating fibrous material to said sheet material between the embossed film and the backing film at least at the longitudinal edges thereof, whereby said edges are reinforced by the fibrous material and said edges may be attached to correspondingly reinforced edges of another said sheet material without substantially weakening the attached sheets of material at the attachments thereof.

2. The process of claim 1 wherein the said plastic films are made of thermoplastic.

3. The process of claim 2 wherein the said plastic films are made of polyethylene or polypropylene.

4. The process of claim 2 wherein the lamination of the said backing film to the said embossed film is by heat sealing.

5. The process of claim 4 wherein the fibers of the fibrous material are made of polyethylene or polypropylene.

6. The process of claim 2 wherein the fibrous material is a thermoplastic and in batt, scrim or fabric form.

7. The process of claim 6 wherein the fibrous material is in the form of a scrim.

8. The process of claim 2 wherein the backing film is in the form of a coextensive lamination of the backing film and the fibrous material.

9. The process of claim 8 wherein the said lamination of the said scrim and backing film is coated on at least one side with a heat sealable coating.

10. The process of claim 2 wherein the fibrous material is in the form of a separate lamination of lightweight scrim and a laminating film.

* * * * *